US010286260B2

(12) United States Patent
Jin

(10) Patent No.: US 10,286,260 B2
(45) Date of Patent: May 14, 2019

(54) TYPE OF GLOW BALL

(71) Applicant: BEIJING WENHAIYANG INDUSTRY & TRADING CO., LTD., Beijing (CN)

(72) Inventor: Zhaoyang Jin, Beijing (CN)

(73) Assignee: Beijing Wenhaiyang Industry & Trading Co., Ltd., Beijing (CN)

( * ) Notice: Subject to any disclaimer, the term of this patent is extended or adjusted under 35 U.S.C. 154(b) by 0 days.

(21) Appl. No.: 15/325,707

(22) PCT Filed: Jul. 10, 2015

(86) PCT No.: PCT/CN2015/000496
§ 371 (c)(1),
(2) Date: Jan. 11, 2017

(87) PCT Pub. No.: WO2016/004748
PCT Pub. Date: Jan. 14, 2016

(65) Prior Publication Data

US 2017/0144032 A1 May 25, 2017

(30) Foreign Application Priority Data

Jul. 11, 2014 (CN) ..... 2014 2 0384764 U

(51) Int. Cl.
*A63B 43/06* (2006.01)
*A63B 39/00* (2006.01)
*F21K 2/06* (2006.01)

(52) U.S. Cl.
CPC ..... *A63B 43/06* (2013.01); *A63B 39/00* (2013.01); *F21K 2/06* (2013.01); *A63B 2207/00* (2013.01)

(58) Field of Classification Search
CPC ..... A63B 43/06; A63B 39/00; F21K 2/06; A63H 27/1058
See application file for complete search history.

(56) References Cited

U.S. PATENT DOCUMENTS 3,539,794 A * 11/1970 Kennerly ..... C09K 11/07 206/219
3,578,962 A * 5/1971 Gerber ..... F21K 2/06 252/700

(Continued)

FOREIGN PATENT DOCUMENTS

CN 2399075 Y 10/2000
CN 2679474 Y 2/2005

(Continued)

OTHER PUBLICATIONS

ISA State Intellectual Property Office of the People's Republic of China, International Search Report Issued in Application No. PCT/CN2015/000496, dated Sep. 18, 2015, WIPO, 6 pages.

*Primary Examiner* — Steven B Wong
(74) *Attorney, Agent, or Firm* — McCoy Russell LLP

(57) ABSTRACT

A kind of glow ball comprises a ball shell made of flexible and transparent material, and an empty cavity is formed in the said ball shell. The said empty cavity contains chemiluminescent reagents (2-A, 2-B), and the said chemiluminescent reagents solid or liquid or solid-liquid mixture, and the said chemiluminescent reagents are two kinds of reagent sealed separately and can generate chemiluminescent reaction when they are combined. At least one kind chemiluminescent reagent is contained in one or more breakable containers. The application adopts that the inner wall of the ball shell is with protrusions or polyhedral or many pits or grooves and/or protrusive ribs and is placed with dispersed particles, such as scraps of paper, plastic film, or small plastic particles, etc.

13 Claims, 4 Drawing Sheets

(56) References Cited

U.S. PATENT DOCUMENTS 3,800,132 A * 3/1974 Postal ..... F21K 2/06 273/DIG. 24
4,015,111 A * 3/1977 Spector ..... A63B 43/06 273/DIG. 24
4,479,649 A * 10/1984 Newcomb ..... A63B 43/06 273/DIG. 24
4,695,055 A * 9/1987 Newcomb ..... A63B 43/06 273/DIG. 24
4,814,949 A * 3/1989 Elliott ..... F21K 2/06 252/700
4,878,674 A * 11/1989 Newcomb ..... A63B 43/06 473/200
4,930,776 A * 6/1990 Newcomb ..... A63B 43/06 273/DIG. 20
4,957,297 A * 9/1990 Newcomb ..... A63B 43/06 473/200
4,963,117 A * 10/1990 Gualdoni ..... A63B 43/06 446/219
5,018,450 A * 5/1991 Smith ..... F42B 12/40 102/498
5,080,359 A * 1/1992 Thill ..... A63B 43/008 273/DIG. 24
5,381,311 A * 1/1995 Fujita ..... C09K 11/07 206/219
5,403,000 A * 4/1995 Woosley ..... A63B 43/06 273/DIG. 24
5,562,290 A 10/1996 Wei
5,709,449 A * 1/1998 Kuo ..... F21K 2/06 362/34
5,882,239 A * 3/1999 Trichak ..... A63H 33/18 446/219
5,924,942 A * 7/1999 Gentile ..... A63B 43/06 446/267
6,059,676 A * 5/2000 Seymour ..... A63B 43/06 473/570
6,485,158 B1 * 11/2002 Bisotto ..... A63H 27/10 362/253
6,575,855 B1 * 6/2003 Buzak ..... A63B 43/06 273/DIG. 8
7,140,972 B2 * 11/2006 Redwine ..... A63B 43/06 473/280
7,261,432 B1 * 8/2007 Habitz ..... A63B 43/06 362/182
8,360,589 B2 * 1/2013 Friedson ..... F21K 2/06 362/101
2003/0199343 A1 * 10/2003 Ilcisin ..... A63B 43/06 473/570
2003/0232672 A1 * 12/2003 Kim ..... A63B 41/00 473/570
2003/0236136 A1 * 12/2003 Dijkgraaf ..... A63B 43/06 473/351
2009/0191990 A1 * 7/2009 Smith ..... A63B 43/06 473/570
2010/0184541 A1 * 7/2010 Kessler ..... A63B 37/08 473/570
2010/0261561 A1 * 10/2010 Wang ..... A63B 37/08 473/594

FOREIGN PATENT DOCUMENTS

| | | | |
|---|---|---|---|
| CN | 2684000 | Y | 3/2005 |
| CN | 2695769 | Y | 4/2005 |
| CN | 201072031 | Y | 6/2008 |
| CN | 201389347 | Y | 1/2010 |
| CN | 102049127 | A | 5/2011 |
| CN | 202802785 | U | 3/2013 |
| CN | 203075674 | U | 7/2013 |
| CN | 204083826 | U | 1/2015 |
| JP | S60222071 | A | 11/1985 |

* cited by examiner

TYPE OF GLOW BALL

CROSS-REFERENCE TO RELATED APPLICATIONS

The present application is a U.S. National Phase of International Patent Application Serial No. PCT/CN2015/000496, entitled "LUMINOUS BALL," filed on Jul. 10, 2015. International Patent Application Serial No. PCT/CN2015/000496 claims the priority to Chinese Patent Application No. 201420384764.0, filed on Jul. 11, 2014. The entire contents of each of the above-cited applications are hereby incorporated by reference for all purposes.

TECHNICAL FIELD

This invention is related to a type of glow ball.

DESCRIPTION OF THE RELATED ART

The chemiluminescent device has always been stick shaped generally, from which glow bracelets, glow eyeglasses were derived. Due to the specialty in the shape of ball structure, it is difficult to obtain the chemiluminescent light, the true sense of glow ball has not occurred. The present invention provides a kind of ball-shaped chemiluminescent device, which fills in the gap. From the point of internal chemical reaction mechanism, the civilian-used chemiluminescent light is generated from the chemical reaction by mixing chemiluminescent chemicals, such as substituted-phenyl Bis oxalate, fluorescent, oxidizer, solvent etc. Generally, the ingredients that contain substituted-phenyl Bis oxalate are called component of chemiluminescent reagents, while the ingredients that contain peroxide are known as the component of oxidizer, both of which are called chemiluminescent chemicals. In different condition, the glowing effect of ingredients with high viscosity or solid could be achieved by using different solvents or dispersants, even not using the solvents. Currently, the Bis(2,4,5-trichloro-6-carbopentoxyphenyl)oxalate (CPPO) or Bis(2,4,5-trichloro-6-i-pentoxycarbonylphenyl)oxalate (CIPO) is most widely used as substituted-phenyl Bis oxalate, which is normally kept separately from the component of oxidizer before using. While using, the isolation between them will be broken to make them mix and glow.

DETAILS OF THE INVENTION

According to the above said problem, this invention aims to provide a type of glow ball, which is bouncing ball, and its internal chemical luminescence system can glow based on the requirements of people.

To accomplish the objectives mentioned above, this invention takes the following technical solution: a kind of glow ball, which consists of a ball shell made of flexible and transparent material, an empty cavity is in the said ball shell, and the glow ball is characterized in that the said empty cavity contains chemiluminescent reagents, the said chemiluminescent reagents are solid or liquid or solid-liquid mixture, and the said chemiluminescent reagents are two kinds of reagent sealed separately and can generate chemiluminescent reaction when they are combined. At least one kind of chemiluminescent reagent is contained in one or more breakable containers.

The above-mentioned glow ball is characterized in that, the said breakable container is sealed glass container or film capsule.

The above-mentioned glow ball is characterized in that, the activating device of the breakable container is set inside the said empty cavity.

The above-mentioned glow ball is characterized in that, the activating device is a bracket capable of supporting and/or fixing a breakable container.

The above-mentioned glow ball is characterized in that, the said brackets include fixing device, a rod connected with the fixing device, one end of the said rod points to the said breakable container, the other end points to the said ball shell inner wall and near or in contact with the said ball shell inner wall, the said fixing device stuck the said breakable containers.

The above-mentioned glow ball is characterized in that, a hole and a sealing plug matched with the said hole are equipped on the said ball shell. A tube is placed from the hole to the empty cavity of the ball shell. A blocking device is set at one end of the tube in the inner empty cavity of the said ball. Leaks are set in the said blocking device. A rod is set in one side of the sealing plug in the ball shell. The end of the rod is provided with a piston which is matched with the inner wall of the tube for movement. The said breakable containers are between the said piston and the said blocking device.

To achieve the object of this invention, a technical scheme is taken, a glow ball comprises a ball shell made of transparent material, and there is an empty cavity inside the ball shell. It is characterized that the said ball shell contains the hole, a sealing plug is set on the said hole, and the chemiluminescence reagents are sealed in the said empty cavity.

The above-mentioned glow ball is characterized in that, the gastight inflatable capsule is equipped inside the said ball shell. And the said chemiluminescent reagents are sealed in the said inflatable capsule or the areas between the said inflatable capsule and the inner wall of the said ball shell.

The above-mentioned glow ball is characterized in that, the said ball shell contains the hole, the sealing plug is set on the said hole, the gastight inflatable capsule is equipped inside the said ball shell, the chemiluminescent reagents are placed inside the inflatable capsule, the said chemiluminescent reagents are two kinds of reagent sealed separately and can generate chemiluminescent reaction when they are combined. At least one kind chemiluminescent reagent is contained in one or more breakable film capsules.

The above-mentioned glow ball is characterized in that, the appearance of the said ball shell is spheroidal or elliptical or oval or polyhedral, meanwhile its inner surface is polyhedral or with many pits or/and protrusions, or with grooves or/and protrusive ribs.

The present invention has the following advantages over adopting the above technical scheme:

The invention adopts the above technical scheme, truly realizes the glow ball contains the glowing liquid inside, fully shows the special effect of liquids glowing, especially the glowing effect of the ball rotating and bouncing, comparing with existing electroluminescence pure flashing etc., are very different, greatly increase the ball entertaining.

The invention adopts many conical protrusions on the inner wall of the ball shell, which can greatly reduce the possibility of the TPU shell puncture and leakage when the glass is broken and after the activation of the ball. It is because the protrusive parts hold the broken glass fragments and control its sharp cutting edge avoid forming enough impact force to puncture the ball wall.

The invention adopts that the inner wall of the ball shell is with protrusions or polyhedral or many pits or grooves or/and protrusive ribs, and that dispersed particles, such as paper scraps, plastic scraps, or small plastic particles are placed within the ball shell, which not only give people a sense of uniform dispersion effect, but also can produce a certain visual shielding effect to the breakable containers and broken pieces to reduce users' discomfort perception of, for example, the glass fragments.

THE BEST EMBODIMENT OF THE INVENTION

Detailed representations combining with attached figures and implementations towards the present invention are as follows.

Figure 1:
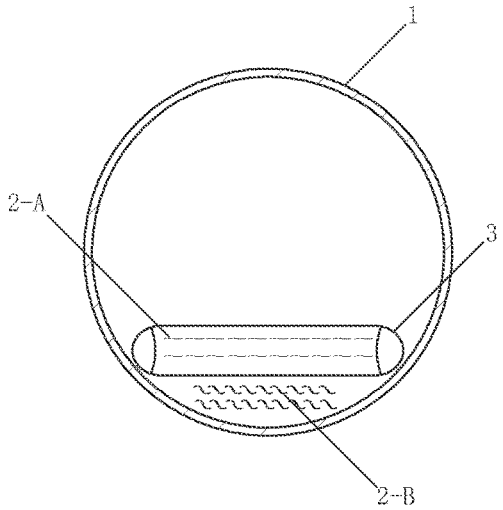
FIG. 1 is the Cross-sectional view of the invention.

As shown in FIG. 1, the invention provides a kind of glow ball, which comprises a ball shell 1, which is made of 1.5 mm-thick, flexible and transparent material- polyethylene (PE). The diameter of the ball shell 1 is 65 mm. 1.5 ml of chemiluminescent reagent (2-B) are placed inside the ball shell 1. The chemiluminescent reagent (2-B) is oxidizing solution containing hydrogen peroxide. The breakable container 3 placed in the ball shell 1 is a glass ampoule with two ends sealed. The wall thickness of the said glass ampoule is 0.3 mm, the length is 50 mm, and the diameter is 9 mm. The glass ampoule is sealed with 1.6 grams of chemiluminescent reagent (2-A), which is luminescence reagents component consisting of Bis Oxalate and fluorescent agent, they can be mixed component of solids or liquids that can be dissolved in solvent. When use, throw the ball to the ground or wall to have the inside glass ampoule broken to make the chemiluminescent reagent (2-A) release. Visible light can be released when the chemiluminescent reagent (2-A) and chemiluminescent reagent (2-B) are mixed to generate Chemiluminescent reaction. The inner surface of the ball shell 1 is covered with glowing liquid caused from bouncing and rolling of the glowing ball. It looks very beautiful. Shattered glass fragments on the shell inner wall also shine. Due to no support inside the glow ball, its wall of the glow ball avoids puncturing. In this embodiment, chemiluminescent reagent (2-A) and chemiluminescent reagent (2-B) can be placed separately in two glass ampoules. When in this way, the release of the chemiluminescent reagents from breaking two glass ampoules can also obtain the glowing effect of the beauty of the liquid and glass fragments.

Figure 2:
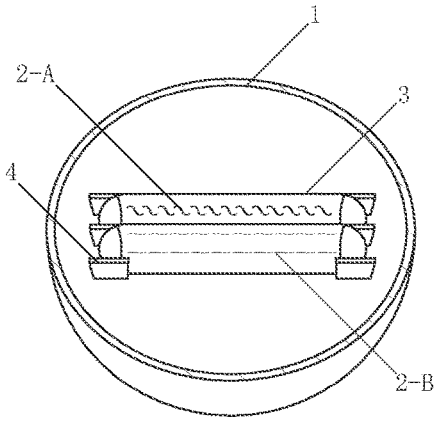
FIG. 2 is the three-dimensional cross-sectional view of the glow ball that contains two breakable containers provided in this invention.
Figure 3:
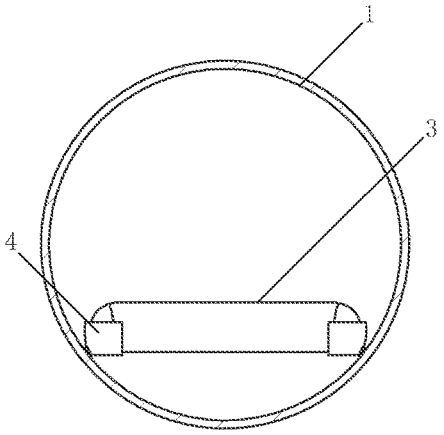
FIG. 3 is the cross-sectional view of the glow ball shown in FIG. 2.

As shown in FIG. 3, FIG. 2, in another preferred implementation example of this invention, a pair of supporting bracket 4 is arranged in the ball shell 1, and the supporting bracket 4 is an activating device. The ball shell 1 is made of flexible and transparent material thermoplastic polyurethane TPU of 3 mm thickness, the ball shell 1 is 150 mm in diameter. Two breakable containers 3 set inside the ball shell 1 are glass ampoule bottles, of which the thickness is 0.5 mm, the length of 140 mm, the diameter is 12 mm, and two ends sealed. Wherein, one breakable container is sealed with 10 ml of chemiluminescence reagent 2-A composed of a light emitting agent containing CPPO and fluorescent agent. The other breakable container is sealed with 10 ml of chemiluminescence reagent 2-B composed of oxidation liquid containing hydrogen peroxide. The above two glass ampoules are embedded within the supporting bracket 4, which make them fixed well for ball shell 1, the supporting bracket 4 can be welded or bonded on the ball shell inner wall, and also can be manufactured integrated together with ball shell 1. When use, throw the ball to the ground or wall, break the glass ampoule to make the chemiluminescence reagent 2-A and chemiluminescence reagent 2-B release, the two reagents are mixed and generate a chemiluminescence reaction, and then release visible light.

On one hand, the supporting bracket 4 protects the glass ampoule in the product transportation, so that the product can be transported safely; on the other hand, when use, the product with the support bracket 4 is more easier to let users find the throwing direction when impact, because the glass ampoule is more easily broken in the horizontal stress, so the glow ball with a supporting bracket 4 is more easy to use for the users.

Figure 4:
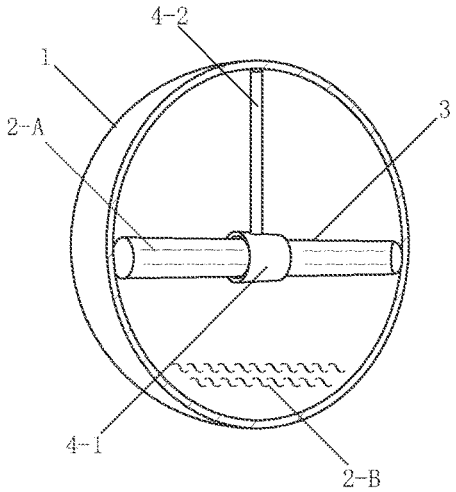
FIG. 4 is the cross-sectional view of the glow ball containing the support rod typed activating device of this invention.

As shown in FIG. 4, in another preferred implementation example of this invention, the ball shell 1 is made of flexible and transparent material thermoplastic polyurethane TPU of 1.5 mm-thick, the ball shell 1 is 65 mm in diameter, and internal seals a 10 ml of chemiluminescence reagent 2-B, which is an Oxidation liquid containing hydrogen peroxide. The breakable containers 3 set in the inner sphere of the ball shell 1, with a wall thickness of 0.45 mm, the length of 50 mm, and diameter of 9 mm, are glass ampoule bottles of two ends sealed. Inside of the breakable container 3 sealed 1.6 g of chemiluminescence reagent 2-A, which is composed of a light emitting agent containing cppo and a fluorescent agent. The two ends of the glass ampoule are in contact with the inner surface of the ball shell 1 and are overhead by the ball shell 1. The activating device 4 is a supporting bracket to fix the glass ampoules. The activating device 4 comprises a tubular fixing device 4-1, which trapped or stuck in the middle part of the glass ampoule. Radial extension of tubular fixtures 4-1 are 4-2 rod, the 4-2 end extends to the inner wall of the contact position of the ball shell 1. When using, press the ball shell 1 with hands, the ball shell 1 will be sunken and squeeze rod 4-2 ,the rod 4-2 move so that the tubular fixing device 4-1 crushes the glass ampoules to make chemiluminescence reagent (2-A) release. The chemical 2-A and chemiluminescence 2-B in the ball shell 1 mix, generate a chemical reaction, and release visible light.

Figure 5:
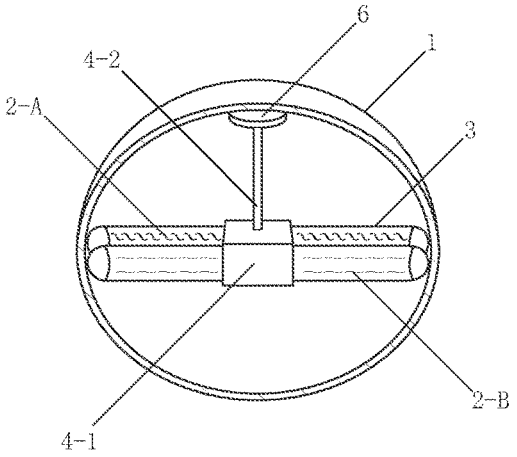
FIG. 5 is the three-dimensional cross-sectional view of the glow ball containing two breakable containers and support rod typed activating device of this invention.

As shown in FIG. 5, in another preferred embodiment of the invention, the ball shell 1 is made of 1.5 mm-thick, flexible and transparent material, thermoplastic polyurethane (TPU), 65 mm in diameter. The two breakable containers 3 set in the ball shell 1 are glass ampoules with two ends sealed, 0.45 mm in thickness of its wall, 50 mm in length, and 9 mm in diameter. There are 1.5 ml chemiluminescent reagents (2-B) sealed in one of the two glass ampoules. The said chemiluminescent reagents (2-B) is oxidizing solution containing hydrogen peroxide. There are 1.6 g chemiluminescent reagents (2-A) sealed in the other glass ampoule. The said chemiluminescent reagents (2-A) is luminescence reagents component consisting of Bis Oxalate and fluorescent agent. The two ends of the glass ampoule are in contact with the inner surface of the ball shell 1 and are overhead by its cavity. The activating device 4 is also a bracket to fix glass ampoules. The said bracket comprises a fixing device 4-1, and a rod 4-2 connected with the fixing device 4-1. In this embodiment, the flat tubular fixing device 4-1 caught or stuck in the middle part of the two glass ampoules. The end of rod 4-2 extends to the contact position of the inner wall of the ball shell 1. A button 6 is located in the end of the rod. Button 6 with enlarged diameter make the user easier to operate, use and press, also reinforce the fixed effect of activating device 4 and ball shell 1. When using, press the ball shell 1 with hands. Then the ball shell 1 will be sunken and squeeze button 6 to drive rod 4-2 move so that the flat tubular fixing device 4-1 crushes two glass ampoules to have chemiluminescent reagents (2-A) and chemiluminescent reagents (2-B) released. The chemical 2-A and chemiluminescence 2-B in the ball shell 1 mix, generate a chemical reaction, and release visible light.

Figure 6:
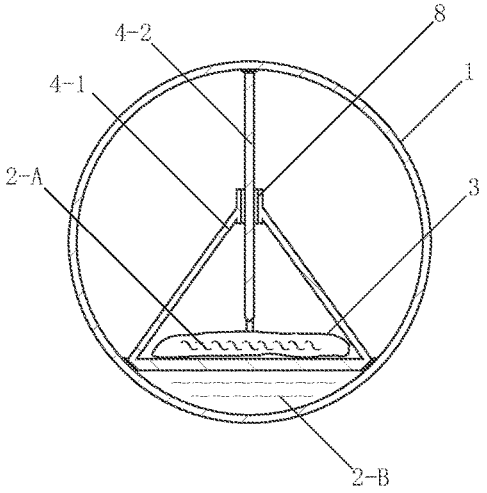
FIG. 6 is the cross-sectional view of the glow ball containing support bracket typed activating device of this invention.
Figure 7:
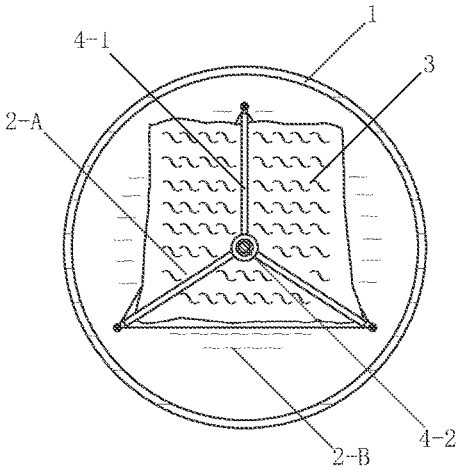
FIG. 7 is the top view of FIG. 6.

As shown in FIG. 6 and FIG. 7, in another preferred implementation example of this invention, the ball shell 1 is made of and transparent material thermoplastic polypropylene PP of 1.5 mm-thick, the ball shell 1 is 80 mm in diameter. Internal seals a 10 ml of chemiluminescence reagent 2-B, which is an Oxidation liquid containing hydrogen peroxide. The breakable containers 3 set in the inner sphere of the ball shell 1, is a thin film with 0.5 mm thick composite foil seal capsule, inside of the breakable containers 3 seals 16 ml of chemiluminescence reagent 2-A, which is a solution containing cppo, fluorescent agent and triethyl citrate solvent. The supporting bracket, the activating devices 4, is a group of hard plastics, which comprises a fixing device 4-1 and a rod 4-2 used to puncture. The tip of the rod 4-2 is arranged above the film sealing bag, and the other end is contacted with the inner surface of the ball shell 1. A guide hole 8 is arranged at the connecting point of the rod 4-2 and the fixing device 4-1, and the rod 4-2 passes through the guide hole 8. When using, press the rod 4-2 from its external of the ball shell 1 The rod 4-2 through the supporting bracket guide hole 8 slides down, the lower tip of the rod 4-2 pierces the breakable container 3 composed of film sealed capsule, and make chemiluminescence reagent (2-A) release. The chemical 2-A and chemiluminescence 2-B in the ball shell 1 mix, generate a chemical reaction, and release visible light.

Figure 8:
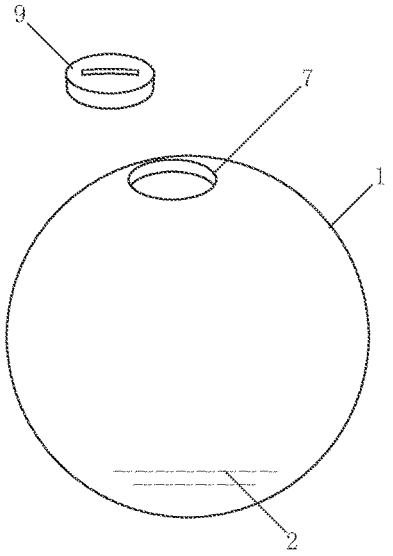
FIG. 8 is the structural drawing of the glow ball containing sealed plug of this invention.

As shown in FIG. 8, in another preferred embodiment of the invention, the ball shell 1 is made of 1.5 mm-thick, flexible and transparent silicone material, 80 mm in diameter. 50 ml of chemiluminescent reagents being chemiluminescent reaction are injected in the ball shell 1. The hollow ball shell 1 is provided with hole 7 and sealed with the sealing plug 9. The said glow ball has advantage in repeated use by opening the sealing plug 9 to pour off the chemiluminescent reagents that stopping glowing and refill new chemiluminescent reagents.

Figure 9:
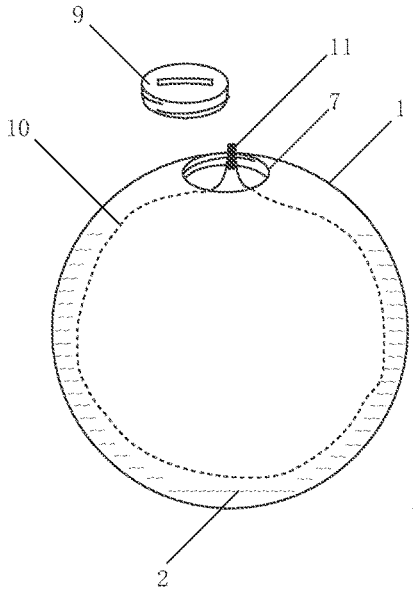
FIG. 9 is the structural drawing of the glow ball containing inflatable inner capsule and sealed plug of this invention.

As shown in FIG. 9, in another preferred embodiment of the invention, the ball shell 1 is made of 1.5 mm-thick, flexible and transparent silicone material, 80 mm in diameter. 2 ml of chemiluminescent reagents being chemiluminescent reaction are injected in the ball shell 1. The hollow ball shell 1 is provided with hole 7. The inflatable capsule 10 is a gastight capsule made of 0.1 mm-thick polyethylene. When the inflatable capsule 10 is flatting, through the hole 7 pump air into the inflatable capsule 10 from the valve core 11 (one-way air inlet). When the inflatable capsule is inflated, the chemiluminescent reagents are extruded to the inner wall of the ball shell 1 and inflatable capsule 10. The ball can be played after its ball shell is sealed with the sealing plug 9. The glow ball has advantage in its glow that can be evenly distributed in the largest area of ball shell.

Figure 10:
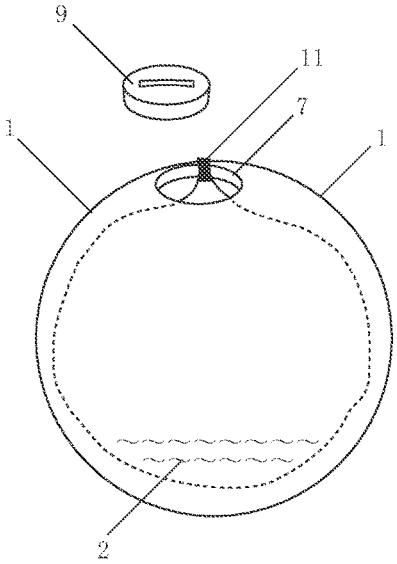
FIG. 10 is the structural drawing of the glow ball containing inflatable inner capsule that filled with chemiluminescent liquids of this invention.

As shown in FIG. 10, in another preferred embodiment of the invention, the ball shell 1 is made of 1.5 mm-thick, flexible and transparent material-PVC, 80 mm in diameter. The hollow ball shell 1 is provided with the hole 7. The inflatable capsule 10 is made of 0.1 mm-thick polyethylene, within 20 ml of chemiluminescent reagents which are being chemiluminescent reaction. When the inflatable capsule 10 is flatting, put it from the hole 7, and pump air into the inflatable capsule 10 from the valve core 11 (one-way air inlet). When the inflatable capsule is inflated, seal the ball shell with the sealing plug 9 before play. The glow ball has advantage in having inflatable capsule 10 with replaceable chemiluminescent reagents, so that the said glow ball used repeatedly. The two kinds of chemiluminescent reagents, one kind of which can react with the other kind, can be set respectively in sealed breakable film pouches in advance, crush the breakable film pouches from outside of the inflatable capsule 10 to make the chemiluminescent reagents mix and glow. Due to the ball shell 1 in this solution can avoid contact with chemiluminescent reagents, the said ball shell 1 in this embodiment can also be made of PET, EVA or TPR.

Figure 11:
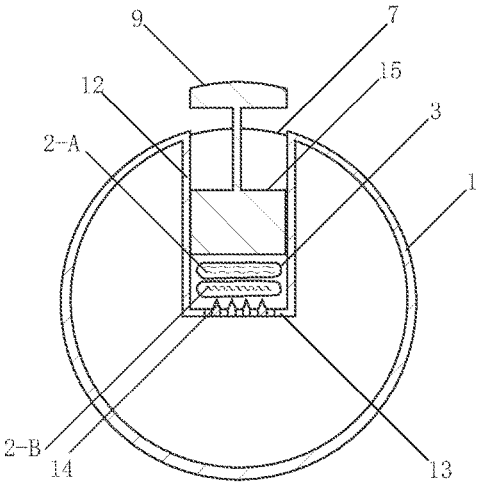
FIG. 11 is the structural section view of the glow ball shell containing with the tube of this invention.
Figure 12:
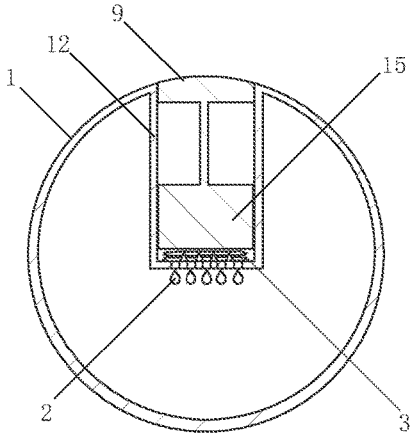
FIG. 12 is the activating device usage view of the said glow ball shown in FIG. 11.

As shown in FIG. 11 and FIG. 12, in another preferred implementation example of this invention, the ball shell 1 is made of 1.5 mm-thick, flexible and transparent material-PP, 80 mm in diameter. The hollow ball shell 1 has the hole 7 with diameter of 15 mm. A 40 mm long conduit 12 extending to the inner ball shell 1 is set in the hole 7 position, the blocking device 13 is set at the top of the conduit 12, and leaks 14 are set in the blocking device 13. The catheter 15 is set within the conduit 12, the sealing plug 9 is set at the top of the catheter 15, and the lower end of the piston 15 is equipped with two breakable container 3. The two breakable containers 3 respectively contain chemiluminescence reagent 2-A and 2 - B, which can be glass ampoule bottle or film sealed capsule. When using, press the sealing plug 9, thereby push the catheter 15 and crush the breakable container to release chemiluminescence reagent. The said chemiluminescence reagent through the leaks 14 flow into the ball shell inside and mix to release light, at the same time, the sealing plug 9 seals the opening 7 to make it become a totally sealed ball.

Figure 13:
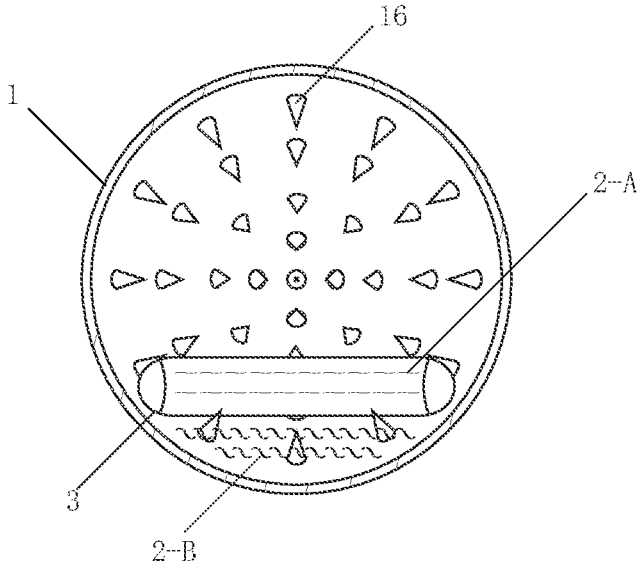
FIG. 13 is the section view of the glow ball containing the protrusions on its shell inner surface of this invention.

As shown in FIG. 13, in another preferred embodiment of the invention, the ball shell 1 is made of 2 mm-thick, flexible and transparent material, TPU, 100 mm in diameter. The breakable containers 3, which is set in the ball shell 1, is glass ampoules with two ends sealed, 0.5 mm in thickness of its wall, 85 mm in length, and 10 mm in diameter. 4 grams of chemiluminescent reagent (2-A) is sealed in the said glass ampoule. The said chemiluminescent reagent (2-A) is luminescence reagents component consisting of Bis-Oxalate and fluorescent agent. The chemiluminescent reagent (2-B) is 4 ml of oxidizing solution containing hydrogen peroxide. A plurality of conical protrusions 16 is provided on inner surface of ball shell 1. Activate the device till it glowing, the conical protrusions 16 of the inner surface can diffuse glowing liquid better to slow down the downward flow and accumulation of the glowing liquid, and then to make its glow more evenly. For the same reason, the inner surface of shell ball 1 may be polyhedral or with many pits or grooves or/and protrusive ribs to make glowing liquid or solid distribute more evenly.

A plurality of conical protrusion 16 on the inner wall of the ball shell 1, which can greatly reduce the possibility of the TPU shell puncture and leakage when the glass is broken and after the ball is played. It is because the protrusive parts hold the broken glass fragments, and the sharp cutting edge can not form enough impact force to pierce the ball wall. In a ball shell 1 TPU ball with a diameter of 65 mm and a wall thickness of 2 mm, two glass ampoule with a diameter of 10 mm, a wall thickness of 0.35 mm, and the length of 60 mm, is placed. Each inside of the ampoule is equipped with chemiluminescence reagent 2 mm, and the air is filled with 2 kg/cm^2 in the ball. In another contrast test, ball shell is 65 mm in diameter, 1.8 mm of wall thickness. The inner wall is covered with a number of protrusive cylinder with a diameter of 1.2 mm and a height of 1.2 mm, and cylindrical interval is 1.2 mm. The ball inside has the said same glass ampoule and is filled with air. The above two ball each has 500 pieces. After breaking up internal ampoule bottle, and from the height of 4 meters throw into the ground 100 times, then check the leakage from puncture of the ball. Four of the ball without internal protrusions were detected with tiny breaches, while the balls with internal protrusions are not found leakage.

Ball shell 1 can be spherical or ellipsoidal or olive shape or polyhedron. Disperse particles can also be placed into the inner empty cavity of ball shell 1 to make the light liquid or solid distribution more evenly or interesting. The particles can be paper scraps, plastic scraps, or small plastic particles etc. Complicated shape or internal dispersed particles can make the glowing liquid or solid more evenly distributed or flow more interesting. The inner wall of the ball shell with protrusions or polyhedral or a plurality of pits or grooves or/and a protrusive rib, and dispersed particles, such as paper scraps, plastic scraps, or small plastic particles are placed within the ball shell, which not only give people a sense of uniform dispersion effect, but also can produce a certain visual shielding effect to the broken containers and broken pieces to reduce users' discomfort perception of, for example, the glass fragments.

In the end illustration of the instant invention, it is understood that the above application example is only used to illustrate the technical scheme of this invention but not interpreted as limiting. Although the instant invention has been described in specific embodiments accompanying better drawings, the normal technical workers can understand it, and can make modification or make equal substitutions of the technical schemes without departing from the spirit and scope of this invention, and all such are defined by the claims of this invention.

The invention claimed is:

1. A type of glow ball comprising a ball shell consisting of flexible and transparent material and an empty cavity surrounded by the ball shell, the ball shell including an exterior surface and an inner surface, where the exterior surface of the ball shell forms an exterior of the glow ball, wherein the empty cavity contains at least two chemiluminescent reagents, the chemiluminescent reagents being solid or liquid or a solid-liquid mixture, wherein the at least two chemiluminescent reagents being encapsulated respectively are configured to generate a chemiluminescence reaction when they are combined, at least one chemiluminescent reagent sealed inside one or more breakable containers, wherein the inner surface of the ball shell is exposed to the empty cavity, wherein the inner surface of the ball shell is polyhedral or has a plurality of pits, protrusions, or pits and protrusions, or has a plurality of grooves, protrusive ribs, or grooves and protrusive ribs formed therein, and wherein the ball shell has a diameter which is 10 times or more as large as a thickness of the ball shell.

2. The glow ball according to claim 1, wherein the one or more breakable containers are sealed glass containers or film capsules.

3. The glow ball according to claim 1, wherein the empty cavity is set with an activating device of the one or more breakable containers.

4. The glow ball according to claim 3, wherein the activating device is a bracket capable of supporting and / or fixing the one or more breakable containers.

5. The glow ball according to claim 1, wherein the ball shell is set with a hole and a sealing plug matched with the hole, a tube placed from the hole to the empty cavity of the ball shell, a blocking device set at one end of the tube in the empty cavity of the ball shell, wherein leaks are set in the blocking device, a rod set in one side of the sealing plug in the ball shell, an end of the rod provided with a piston which is matched with an inner wall of the tube for movement, the one or more breakable containers between the piston and the blocking device.

6. The glow ball according to claim 1, wherein an appearance of the ball shell is spheroidal or elliptical or oval or polyhedral.

7. The glow ball according to claim 1, wherein the one or more breakable containers are tubular glass ampoules.

8. The glow ball according to claim 1, wherein the ball shell has a diameter which is 21.6 to 100 times as large as the thickness of the wall of the ball shell.

9. The glow ball according to claim 1, wherein the inner surface of the ball shell has a plurality of protrusions.

10. The glow ball according to claim 9, wherein the plurality of protrusions has a diameter which is less than the thickness of the ball shell.

11. The glow ball according to claim 9, wherein the plurality of protrusions has a height which is 0.3 to 2 times as large as the thickness of the ball shell.

12. The glow ball according to claim 1, wherein there is no fixing member, supporting member, puncturing member, or connecting rod for fixing, supporting, puncturing, or connecting the one or more breakable containers on the ball shell.

13. The glow ball according to claim 1, wherein there are two chemiluminescent reagents that are each encapsulated within separate breakable containers, the separate breakable containers positioned within the empty cavity, and wherein the one or more breakable containers are tubular glass ampoules.

* * * * *